United States Patent [19]

Bernard et al.

[11] Patent Number: 4,751,918

[45] Date of Patent: Jun. 21, 1988

[54] ANTI-BEDSORE BED HAVING ALTERNATIVELY DRIVEN ROLLERS TO DISPLACE USER

[76] Inventors: Jean M. Bernard, 29 route de Versailles, 78 560 Le Port Marly; Jean M. Bruelle, 22 Bld du Faubourg St Denis, 75 010 Paris, both of France

[21] Appl. No.: 918,703

[22] Filed: Oct. 14, 1986

[30] Foreign Application Priority Data

Oct. 15, 1985 [FR] France ..... 85 15248

[51] Int. Cl.[4] ..... A61H 15/00

[52] U.S. Cl. ..... 128/57; 128/52

[58] Field of Search ..... 128/57, 52

[56] References Cited

U.S. PATENT DOCUMENTS

| | | | |
|---|---|---|---|
| 1,593,014 | 7/1926 | Bashmiller | 128/57 |
| 2,052,656 | 9/1936 | Prien | 128/57 |
| 2,593,982 | 4/1952 | Cash | 128/57 |
| 2,840,072 | 6/1958 | Stearns | 128/57 |
| 3,496,205 | 5/1969 | Minohara | 128/57 |
| 4,154,232 | 5/1979 | Fukazawa | 128/52 |
| 4,192,296 | 3/1980 | St. Mary | 128/57 |
| 4,267,610 | 5/1981 | Blakeway et al. | 128/57 |
| 4,494,260 | 1/1985 | Olds et al. | 128/52 |
| 4,625,487 | 12/1986 | Blakeway | 128/52 |

FOREIGN PATENT DOCUMENTS

| | | | |
|---|---|---|---|
| 2831132 | 1/1979 | Fed. Rep. of Germany | 128/57 |
| 2949366 | 5/1981 | Fed. Rep. of Germany | 128/57 |
| 3215763 | 11/1983 | Fed. Rep. of Germany | 128/57 |
| 2108392 | 5/1983 | United Kingdom | 128/57 |

*Primary Examiner*—Edgar S. Burr
*Assistant Examiner*—Tonya Lamb
*Attorney, Agent, or Firm*—Larson and Taylor

[57] ABSTRACT

The bed comprises a plurality of rollers (9, 10) disposed in parallel side by side relation to one another for supporting the person in bed, and a mechanism for imparting to these rollers a relative movement relative to the body of the person in bed whose bearing points on the rollers change constantly.

11 Claims, 4 Drawing Sheets

ANTI-BEDSORE BED HAVING ALTERNATIVELY DRIVEN ROLLERS TO DISPLACE USER

The present invention relates to a bed for avoiding the appearance of bedsores on the body of a person who is confined to bed for a prolonged period.

The most frequently used means for avoiding bedsores, which are due to a permanent compression of the skin and the subjacent tissues against the bone, are the following: the turning over of the patient and the caring of the risk zones; the use of a mattress containing a fluid such as air or liquid, the flow of which tends to vary the bearing pressure; the use of a mattress comprising means for projecting sand or other particles for the purpose of beating the skin and favouring its vascularization.

The regular turning over and the caring of the skin require numerous expensive persons. As concerns the various types of mattress, they are costly and require much maintenance.

Further, these various means do not avoid rather prolonged contacts of the skin with the surface of the bed and often do not manage to avoid the appearance of bedsores.

The object of the present invention is to overcome these drawbacks and to provide an anti-bedsore bed which avoids in a certain manner a prolonged contact between the skin and the surface of the bed.

Another object of the invention is to provide a bed which affords a permanent massaging of the surfaces of the body resting on the bed.

Another object of the invention is to provide such an anti-bedsore bed which ensures a stimulation of the skin which facilitates its vascularization.

Another object of the invention is to provide an anti-bedsore bed which avoids risks of maceration of the skin against the surface of the bed.

Another object of the invention is to provide such a bed which ensures that a patient does not remain in contact with excretions or exudations.

Yet another object of the invention is to provide such a bed which avoids the necessity of frequent caring and which may be used by but little qualified personnel.

Yet another object of the invention is to provide such a bed which is cheap and easy to maintain and clean.

The present invention relates to an anti-bedsore bed characterised in that it comprises a plurality of rollers disposed in parallel side by side relation to one another for supporting the person in bed and means for imparting to these rollers a movement relative to the body of the person in bed.

In a preferred embodiment of the invention, the rollers are in direct contact with the body of the patient without interposition of an under sheet.

In a particularly preferred embodiment, the rollers undergo a movement which causes the displacement of the patient alternately in one direction and the other. As a variant, the rollers may themselves move relative to the patient who then remains stationary.

However, in another embodiment, the movement of the rollers relative to the body of the patient can be arranged as to avoid producing a relative displacement of the patient in the plane of the bed by achieving a certain vertical displacement between the rollers and the patient.

In a particularly preferred embodiment, the rollers have projections which are equally spaced apart in the axial and/or radial direction. Thus, for example, the rollers may be provided with a plurality of radial points which are brought successively into contact with the body of the patient by the rotation of the roller.

Instead of points, the rollers may also comprise ribs separated from one another by grooves. Preferably, the rings or the points of two adjacent rollers are disposed in such manner as to be axially offset so as to achieve a partial overlapping of their paths when viewed in the axial direction.

The surface of the rollers is preferably formed from an elastomeric material having a certain elasticity or from a synthetic material having similar characteristics.

In another embodiment of the invention, the rollers may have eccentric shapes relative to their axis of rotation with preferably an angular offset between the eccentricities of two consecutive rollers so that the bearings against the rollers regularly alternate.

The movement of rotation of the rollers may be advantageously imparted by transmission means such as a rack or a chain, but any other transmission means may also be employed.

The bed according to the invention is advantageously arranged in such manner that the rollers may be easily removed, in particular for cleaning purposes.

The driving of the rollers is preferably achieved by an electric drive. However, advantageously, manual driving means may also be provided for at least some of the rollers.

The bed according to the invention may be arranged to have solely a horizontal surface. However, according to improvements, the bed may also have parts having an inclined surface for example for maintaining a patient in a seated or semi-reclining position. In this case, if there are used for the horizontal part rollers producing a displacement of the patient relative to the bed in the plane of the rollers, there may advantageously be provided one or more inclined parts acting for example as a backrest which follows the same movement. As a variant, by the use of eccentric rollers, the rollers may be rotated in such manner that the patient undergoes only a substantially vertical movement. The part of the bed forming a backrest may also be provided with rollers if desired. Lastly, the various parts of the bed may be formed by rollers of different nature and kinetics.

Advantageously, there may be provided under the roller forming the bed, a pan for collecting exudations or excretions or other matters.

Other advantages and characteristics of the invention will be apparent from the following description which is given by way of a non-limiting example with reference to the accompanying drawing, in which.

Figure 1:
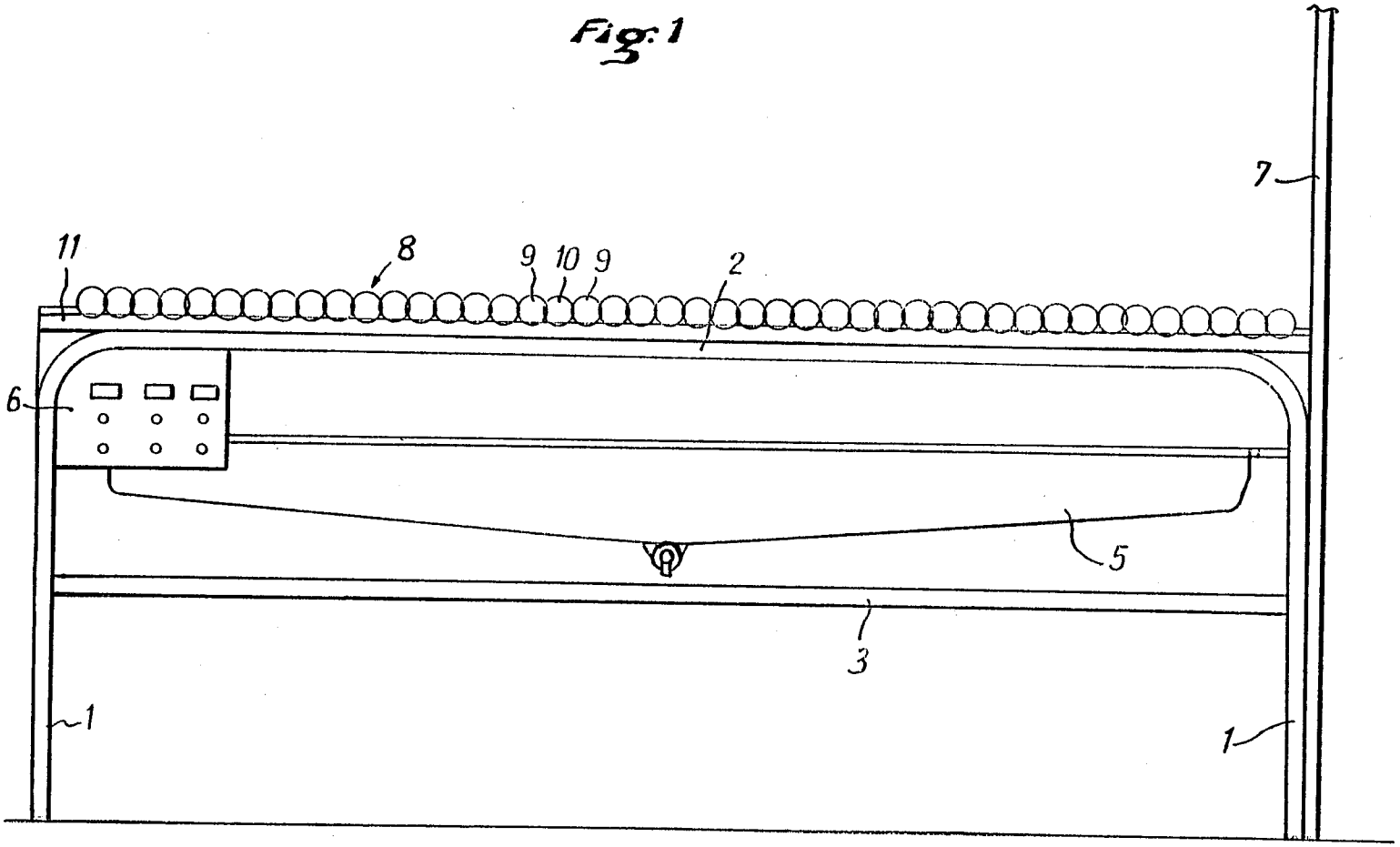
FIG. 1 represents a diagrammatic elevational view of a bed according to the invention.

With reference to FIG. 1, there is seen a bed according to the invention which has a frame with four legs 1, two upper posts 2 and two lower posts 3. Cross-members 4 interconnect the legs 1 in pairs at the same level as the posts 2 and 3, these cross-members not being seen in the Figure. The frame thus formed supports a discharge pan 5 disposed under practically the whole of the surface of the bed, a control panel 6 and roller driving means which will be described in detail hereinafter. An usual support 7 may be fixed in position for receiving possible perfusion bags or bottles.

The upper part of the bed, on which the patient lies, is formed by a juxtaposition 8 of individual rollers 9, 10; these rollers each having at their two ends an axial extension by which they are pivotally mounted on suitable longitudinal supports generally designated by 11.

Figure 2:
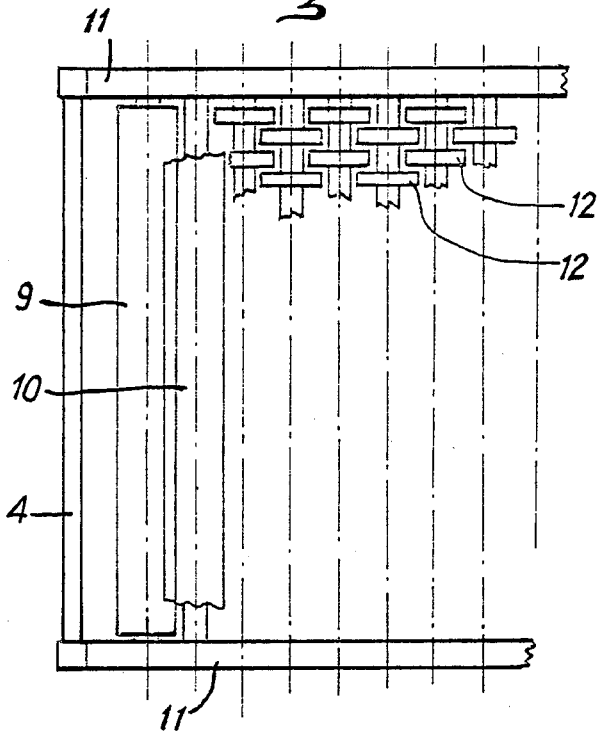
FIG. 2 represents a partial top view of this bed.
Figure 3:
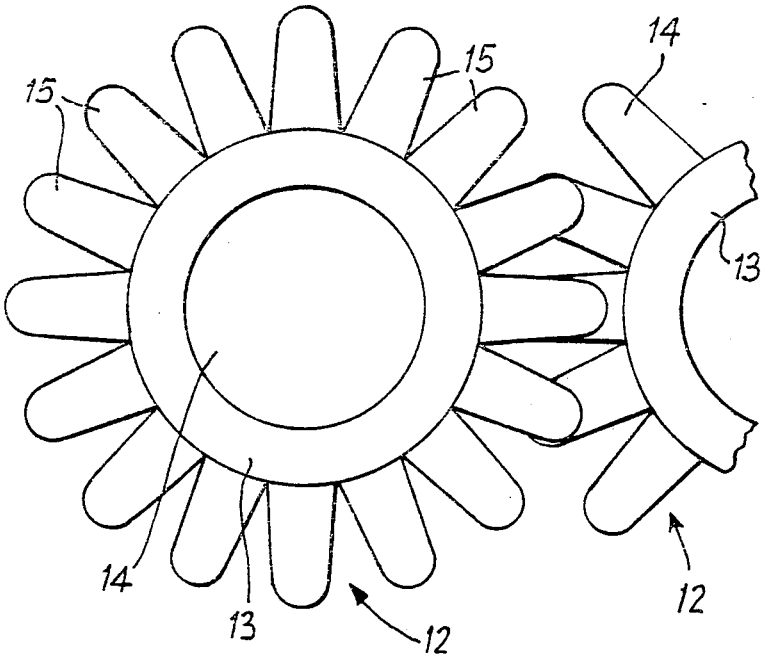
FIG. 3 represents an elevational view of a roller according to the invention.
Figure 4:
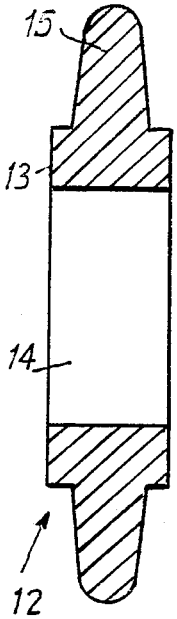
FIG. 4 represents a sectional view of an element of this roller.

With reference more particularly to FIG. 2, it can be seen that the rollers 9 and 10, which are alternately disposed, in fact each comprise a juxtaposition of elements 12 having points whose shape is seen better in FIGS. 3 and 4. The elements 12 having points of the rollers 9 are axially offset relative to the elements 12 having points of the rollers 10 so as to ensure an overlapping permitting an interpenetration of the paths of the points, when viewed in the transverse direction of the bed.

The elements 12, such as seen in FIGS. 3 and 4, are preferably formed by moulding an elastomer or plastics material having a certain flexibility. Each element 12 is in the form of a ring 13 defining a cylindrical central passage 14, this ring being extended, on its peripheral surface, by a plurality of frustoconical points having blunted ends 15. The number of points may vary. It is advantageously on the order of 14 to 18.

By way of example, the width of the ring 13 is on the order of 10 mm, the diameter of the passage 14 on the order of 20 mm, the radial thickness of the ring on the order of 5 mm and the outside diameter, i.e. the diameter of the circular path of the apices of the points, on the order of 50 mm.

The width of the points, which progressively decreases toward the blunted apex, is less than the width of the ring 13 and it can be seen that it is thus possible to obtain the interpenetration of the paths of the points of the elements of two adjacent rollers 9, 10, as is represented for example in FIG. 3.

To form a roller, the various elements 12 are mounted with a force fit on a tube 16 (see FIG. 6) which extends through the passages 13 of the various elements 11 which are thus connected to the tube 16 as concerns rotation and translation. The tube is closed at both ends by simple caps 17. Of course, depending on whether it concerns a roller 9 or 10, the axial position of the elements 12 on the tube 16 is so arranged that there is obtained the overlapping of the paths of the points 15 of the elements 12 of the respective rollers 9 and 10.

However, instead of stacking the elements such as 12, there could also be formed sleeves provided with points and extending throughout the width of the bed, the tubes 16 extending therethrough.

Figure 5:
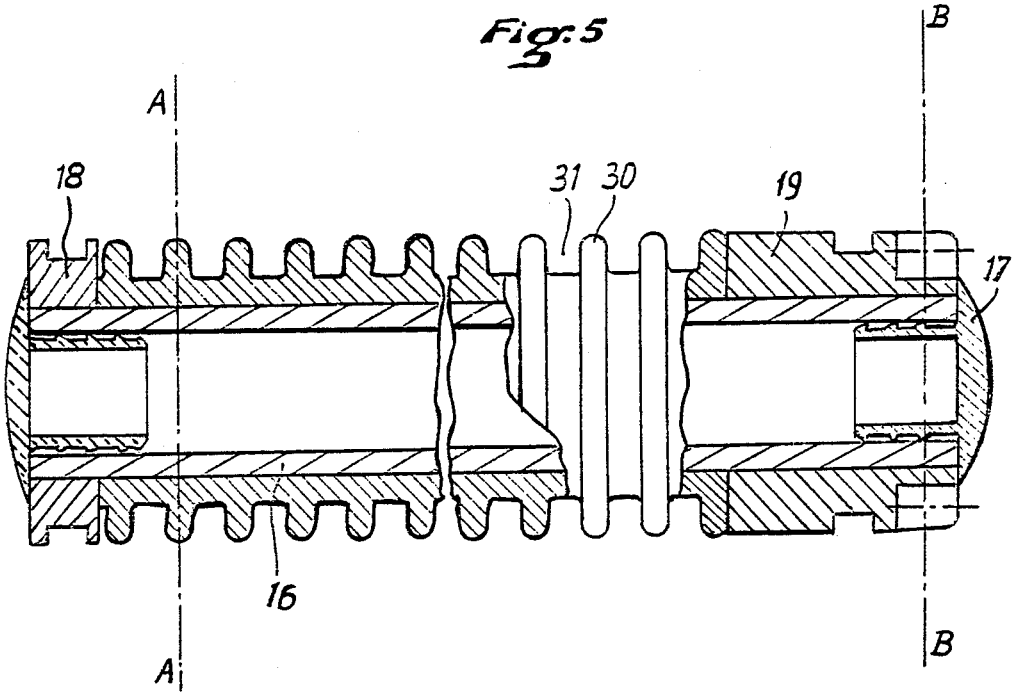
FIG. 5 represents an axial sectional view of a roller according to a variant of the invention.
Figure 6:
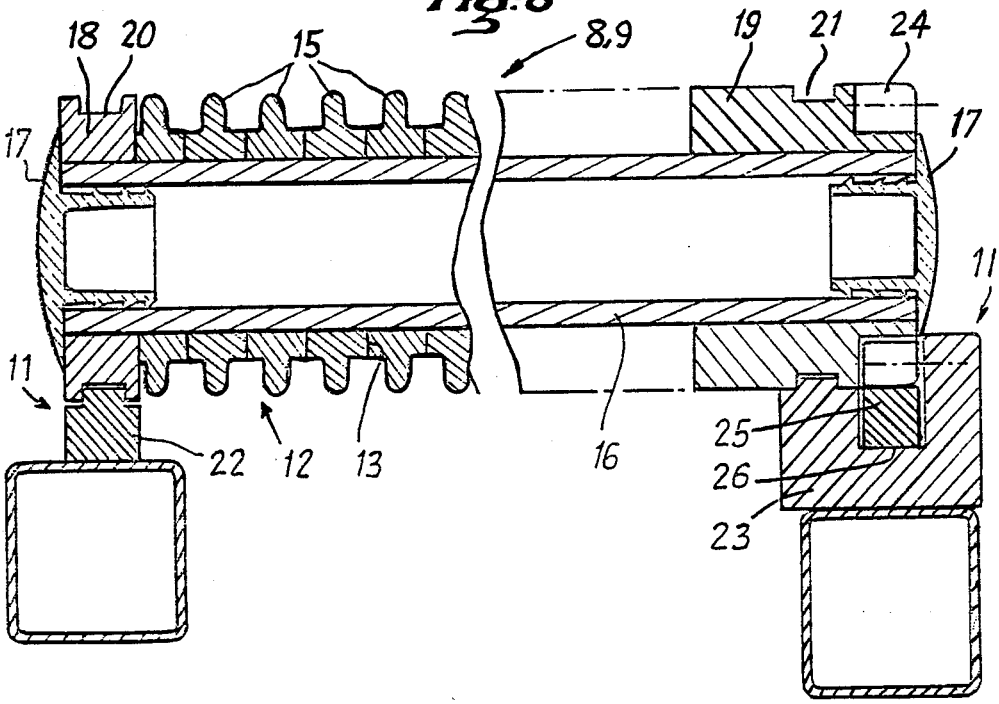
FIG. 6 represents a sectional view of a roller with its driving means.

As has been seen, the ends of the rollers 9, 10, i.e. of the tubes 16 in the presented embodiment, are journalled on elements generally represented by 11 and extending along the upper posts of the bed. This may be achieved in different ways. Thus, in a simple embodiment which is seen in FIGS. 5 and 6, the tubes 16 have at their ends rings 18, 19 which are connected to rotate with the tubes, these rings having grooves 20, 21, the bottom of which bears on rectilinear strips 22, 23 provided on their upper side with a shoulder extending into the grooves 20 or 21. In other words, the various rollers 9, 10 are merely placed on the strips 22, 23, the bottoms of the grooves 20, 21 of two adjacent rollers 9, 10 being in the tangential contact so that, provided the end rollers of the bed are themselves mounted so as to be incapable of moving along the strips 22, 23, all the rollers are incapable of moving in translation relative to the strips while they are rotatable on the latter with, of course, friction on the strips and friction between the contacting rings of two adjacent rollers. These rings may be easily constructed from a self-lubricating plastics material so that the friction becomes negligible.

Figure 7:
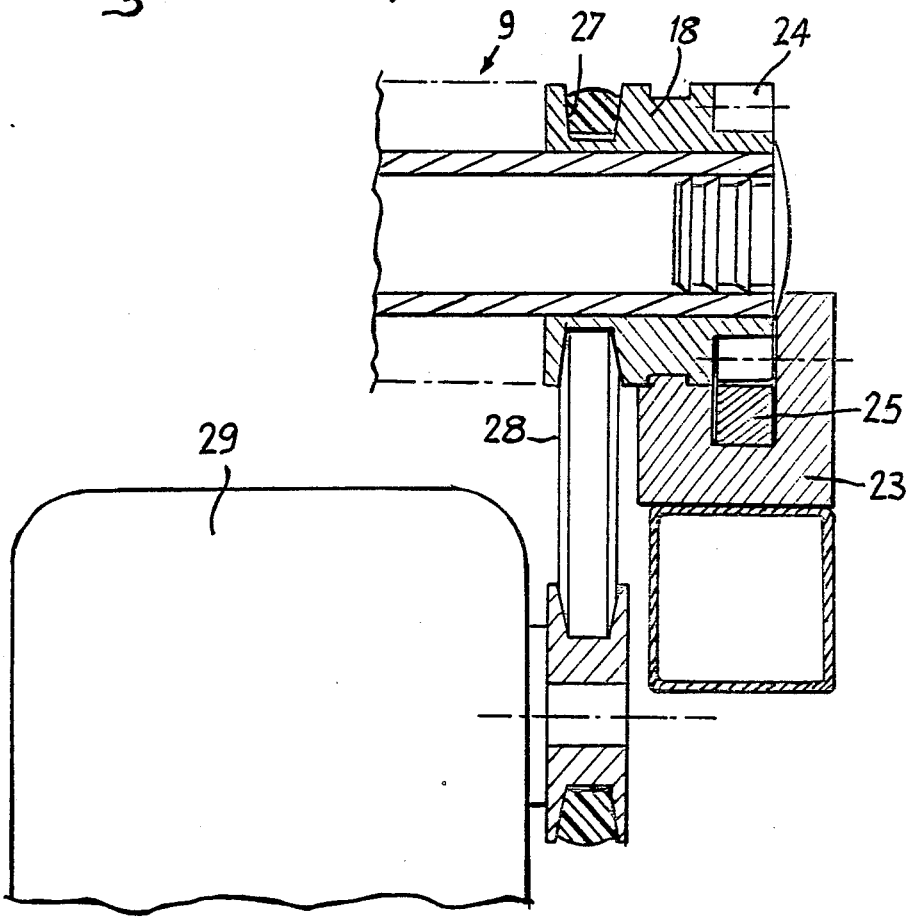
FIG. 7 represents a view of an end driving roller of a bed according to the invention.

For the purpose of driving all the rollers in rotation, there are provided, on the rings 19 of all the rollers, teeth 24 which engage with a single rack 25 which slides in a groove 26, constituting a slideway of the strip 23, and undergoes a to and fro movement which is preferably imparted thereto by one of the end rollers 9 whose ring 19 has a pulley groove 27 driven by a belt 28 which is itself made to undergo an alternating movement by an alternating motor 29 fixed to the frame of the bed, as can be seen in FIG. 7.

It will be understood that other types of drive could be provided, for example, a toothed belt could be used instead of the rack. Likewise, the teeth of the various successive rings 19 could be made to directly engage one another, the rings 19 of the rollers 9 being connected to rotate with the rollers and the rings 19 of the rollers 10 being freely movable on the rollers 10 so that only the rollers 9 would be driving rollers, the rollers 10 merely following the movement under the effect of the movement of the patient. Indeed, it is not indispensable to arrange that all the rollers be driven by the driving means.

Likewise, the mounting of the rollers could be modified. Thus, the ends of the rollers, for example the rings 18, 19, could be mounted, not on a rectilinear horizontal surface of a strip, but in semicircular notches of a member which replaces the strip. As a variant, the ends of the rollers could be mounted by causing them to journal in bearings, but such a solution is less advantageous since it would require a disassembly of the bearings for the removal and the mounting of the rollers whereas the previously-described solutions permit the mounting and the removal of a roller without the slightest disassembling operation.

The operation is as follows: with all the rollers 9, 10 placed in position in an alternating manner and with the patient lying directly on the horizontal surface formed by the various rollers with their points, the motor 29 is started up and imparts to all of the rollers a movement which alternately drives the patient toward the foot of the bed and toward the head of the bed. The amplitude of this movement is preferably limited from 5 to 30 cm and the speed from 5 to 60 cm/h. Consequently, the patient comes successively into contact with the various points 15 of the various rollers during his displacement relative to the rollers. The points of contact between the patient and the bed, determined by the points 15, consequently constantly change so that the bedsore effect is avoided. Further, the successive contact of the various points, related to a certain elasticity of the latter, results in a local beating producing a massaging effect which initiates and facilitates the local circulation of the blood.

The invention may of course be subjected to numerous modifications.

Thus, with reference to FIG. 5, it can be seen that there may be used instead of rollers having points, grooved rollers having an alternating arrangement of circular ribs 30 and circular grooves 31, the rollers being preferably arranged in such manner that the ribs 30 somewhat penetrate the grooves 31 of the adjacent roller. In this way a displacement of the patient is achieved which avoids the appearance of bedsores. This solution is however not preferred, since the beating effect is reduced.

Figure 8:
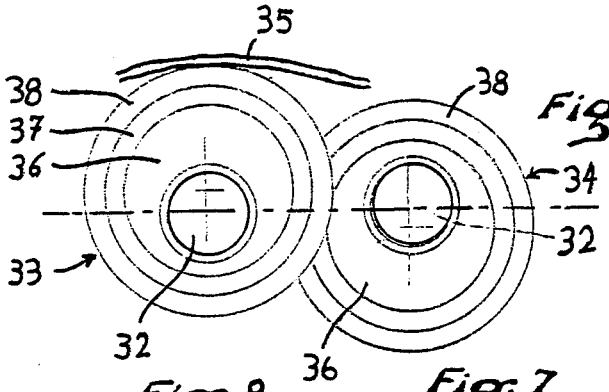
FIGS. 8 and 9 represent a diagrammatic view of a plurality of parallel rollers in another embodiment of the invention.
Figure 9:
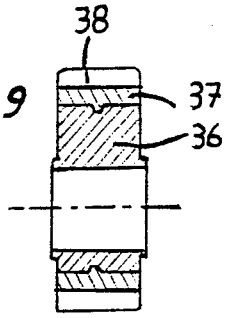

Reference is now made FIGS. 8 and 9.

In this embodiment, the rollers are made in the form of continuous cylinders mounted in an eccentric manner about rotary shafts 32 for example driven in rotation by a rack. These rollers are all identical to one another but are angularly and alternately offset, for example by 180°, so as to form rollers 33 and 34 which are in alternating phase opposition.

The continuous cylinder may be replaced by a cylinder formed by a stack of eccentric rings in accordance with angularly offset, for example alternating, positions, which permits an overlapping of two adjacent cylinders.

An under sheet 35 may be provided, this under sheet being fixed relative to the bed in such manner that it is incapable of being driven by the rollers.

The rollers may thus be driven in a uniform movement of rotation always in the same direction and, in so doing, they merely result in an alternating raising and lowering of the under sheet 35, against which they slide, in the various positions of the rollers. The patient, who lies on the under sheet is therefore alternately in contact with the points of the under sheet in the region of the rollers 33 and then the rollers 34, and so on. The under sheet may be replaced by flexible sleeves each surrounding the rollers and in which the rollers slide. As a variant, provided the rollers undergo an alternating movement, as in the case of the previously-described rollers provided with points, the under sheets and the sleeves could be eliminated so that the patient receives a certain alternating movement of translation. The rollers 33, 34 could for example comprise a self-lubricating plastics ring 36 mounted to be a force fit on the shaft 32, surrounded by a second self-lubricating plastics ring 37 which may pivot on the ring 36, which permits eliminating the under sheet 35, the ring 37, which is rendered axially stationary relative to the ring 36 by a groove-and-rib locking, being surrounded by an elastomeric contact coating 38. The rollers 33 and 34 may interpenetrate by overlapping of their elements 38 or otherwise. The various elements constituting a roller may be alternately offset by 180°.

The invention may still of course be subjected to many modifications. Thus, the various rollers, instead of being transverse could be longitudinal, the patient being, for example in the case of rollers having points or grooved rollers, displaced not longitudinally but transversely in the bed.

Further, the driving of the rollers, instead of being effected by a motor, which of course requires safety end-of-travel devices for limiting the movement of the patient in the case of an incident, could be effected manually by the hospital personnel at regular intervals.

We claim:

1. An anti-bedsore bed, characterized in that is comprises a plurality of rollers disposed in parallel side by side relation to one another for supporting a person in a plane of the bed, each said roller having a plurality of radial projections which are evenly spaced apart in the axial direction of the respective roller and which serve as the sole direct support for the person on the bed, the spaced projections of two consecutive rollers being axially offset from one another, and a means for producing an alternating displacement of the person in the plane of the bed comprising means for alternately driving all of the rollers first in one rotational direction and then in a reverse rotational direction.

2. A bed according to claim 1, characterized in that said driving means includes a direct drive means for one of the rollers for driving the one roller directly, and an indirect drive means for connecting the other rollers to the one roller whereby the movement of the one roller by the direct drive means causes all of the other rollers to move as well.

3. A bed according to claim 1, characterized in that the rollers comprise individual elements stacked in side by side relation to one another, each element having a said projection thereon.

4. A bed according to claim 1, characterized in that support strips are provided on which the rollers are mounted to roll rectilinearly.

5. A bed according to claim 4, characterized in that a ring is provided at each end of each roller for supporting the respective roller rotatably on respective support strips.

6. A bed according to claim 5, characterized in that certain of said rings have teeth cooperating with said driving means, said driving means including a rack which moves relative to one of the support strips.

7. A bed according to claim 1, characterized in that said radial projections of the rollers are evenly spaced apart in the radial direction from the projections of an adjacent roller.

8. A bed according to claim 7, characterized in that the projections are circular ribs separated by grooves.

9. A bed according to claim 7, characterized in that the projections follow rotational paths which paths partially overlap.

10. A bed according to claim 7, characterized in that the rollers are provided with a plurality of radial points forming each projection and these points are brought successively into contact with the body of the patient by the rotation of the roller to provide the direct support of the person.

11. A bed according to claim 10, characterized in that the surface of the rollers, and in particular of said elements, is made from an elastomeric material.

* * * * *